United States Patent [19]

Johnssen

[11] 4,060,040

[45] Nov. 29, 1977

[54] ANTITHEFT SYSTEM FOR SALES AREAS

[76] Inventor: Friedrich Karl Johnssen, Kiefernhalde 23, Essen, Germany, 4300

[21] Appl. No.: 682,032

[22] Filed: Apr. 30, 1976

[30] Foreign Application Priority Data

May 3, 1975 Germany ..... 2519799

[51] Int. Cl.[2] ..... G08B 13/00; E05G 1/10

[52] U.S. Cl. ..... 109/40; 109/38

[58] Field of Search ..... 109/23, 31, 38, 39, 109/40; 116/75, 77; 340/276

[56] References Cited

U.S. PATENT DOCUMENTS

| | | | |
|---|---|---|---|
| 1,049,783 | 1/1913 | van Pee | 116/77 |
| 1,198,581 | 9/1916 | Ritchel | 109/40 X |
| 2,273,440 | 2/1942 | Gould | 109/39 |

FOREIGN PATENT DOCUMENTS

| | | | |
|---|---|---|---|
| 2,160,041 | 6/1973 | Germany | 109/38 |
| 2,204,743 | 8/1973 | Germany | 109/38 |
| 1,409,608 | 10/1975 | United Kingdom | 109/38 |

*Primary Examiner*—Paul R. Gilliam
*Assistant Examiner*—David H. Corbin
*Attorney, Agent, or Firm*—Karl F. Ross

[57] ABSTRACT

An antishoplifting system for premises in which goods are sold and in which signal transmitters are affixed to the articles of goods. Each of the transmitters has a continuously effective first signal emitter which cooperates with a detector at the entrance or exit of the premises to signal removal of an article with the transmitter thereon. In addition, each transmitter comprises a self-contained second signal emitter, which requires no external energy source and is activatable upon removal of the transmitter from the goods to emit a signal. Receivers on the premises detect this signal and produce an output indicating the location of the source thereof.

9 Claims, 7 Drawing Figures

ANTITHEFT SYSTEM FOR SALES AREAS

FIELD OF THE INVENTION

The present invention relates to an antishoplifting system for articles of goods displayed on the premises and, more particularly, to a signal transmitter which can be affixed to the goods to prevent their surreptitious removal from the premises.

BACKGROUND OF THE INVENTION

In public sales premises, the loss of goods through shoplifting is significant, especially where high-priced clothing is accessible to the general public for try-on or examination. Since clothing can constitute expensive articles and personal supervision of each individual having access to garments on racks, shelves and tables is not practical, it has been proposed to prevent losses resulting from shoplifting by means of various monitoring systems.

For example, it is not uncommon to affix to a garment a "signal transmitter" containing a continuously effective signal emitter, e.g. a source of radioactivity, an induction coil, or a remotely activatable output generator, which can cooperate with a receiver or monitoring device at the entrance or exit of the premises to generate an alert when a garment carrying the transmitter passes through the portals. The sales person, cashier or other member of the staff is generally equipped with a special tool for removing the signal transmitter after the sales transaction has been completed so that the garment may be free from the transmitter when legitimately removed from the premises.

While this system has been highly successful in preventing the removal of garments with signal transmitters, it does not solve the problem of theft involving the removal of the signal transmitter from the garment. In spite of the fact that such removal is difficult without special tools, the ingenuity of the thief has not been thwarted by the devices used heretofore. As a result a thief taking the garment into a dressing room or some other relatively concealed location may be capable of removing the transmitter and leaving the premises with the garment without the transmitter. Since the monitoring devices, which respond only to the proximity of the transmitter, will not be activated in these cases, the conventional systems are ineffective against theft in this manner.

The removal of the transmitter is common with professional thieves so that, against such persons, the conventional system is no protection.

OBJECT OF THE INVENTION

It is the principal object of the present invention to provide an antitheft system which obviates the aforementioned disadvantages and provides a more complete protection against shoplifting than the systems used heretofore.

SUMMARY OF THE INVENTION

This object and others which will become apparent hereinafter can be achieved, in accordance with the present invention, by providing the signal transmitter, which formed as is customary with a continuously effective first emitter, with a self-contained second signal emitter automatically triggerable upon removal of the transmitter from the garment to produce a signal which is detected by a plurality of receivers on the premises and is capable of localizing (locating) the source of the signal. The second emitter is self-contained, i.e. requires no external or depletable energy supply.

The second or active signal emitter is distinct from the first or passive signal emitter in that it only generates a detectable signal when activated by the removal of the transmitter from the garment. The first or passive emitter remains continuously effective to signal its proximity to the aforementioned monitoring means.

While the signal transmitter is normally affixed to the garment, the second signal emitter is ineffective and incapable of producing an output. However, at any attempt at its unauthorized removal, it is automatically and unavoidably activated.

Since such an attempt can occur anywhere on the sales premises, the receivers for this signal are preferably spaced about the premises and are connected with circuit means for localizing the source of the signal, thereby enabling the thief to be caught in flagrante.

The system of the present invention thus offers double security against theft in that it prevents the unauthorized removal of the garment from the premises with the transmitter affixed thereto as well as unauthorized removal of the transmitter from the garment.

According to a feature of the invention, the signal transmitter comprises a trigger device which may be set by external operation in to a cocked or triggerable state from which it cannot be deactivated from the exterior unless special and authorized means are used. Thus, once the device is set or cocked, a thief cannot deactivate it.

The triggering device preferably comprises a swingable trigger lever having a finger or arm resting against the goods and fulcrumed in the transmitter housing. A pin is spring-loaded in the housing and engaged by this lever to prevent it from acting upon the second signal emitter until the transmitter is removed from the garment and the finger is released, whereupon the lever disengages the pin which activates the second signal emitter.

For setting the device from the exterior, the spring may bear against a seat which can be pressed into the housing through a bore thereof and may be provided with a unidirectionally effective detent which can lock into the housing to stress the spring. Since the seat cannot be withdrawn aginst the unidirectional detent, the system cannot be deactivated and, because the seat is constituted as a pushbutton which can be simply pressed into the housing, the setting of the device is relatively simple.

The detent can be formed by rearwardly diverging elastic projections formed on the pushbutton and engageable against abutments around the bore. It is also possible to constitute the pushbutton as a pin which is received in a spring ring which seizes the pin as it is pushed in and prevents its withdrawal.

Of course, the signal transmitter of the present invention must be removed for a normal business transaction, after the article has been paid for, without activating any alert. To this end, a special tool can be inserted into the housing to deactivate the transmitter. It has also been found to be advantageous, because of the low cost of the transmitter which can be primarily constructed of discardable synthetic-resin material, to apply an inductive field to the transmitter to heat the spring and destroy the latter by resonance heating. Another alternative is to provide a magnetically operable latch in the housing which can be activated from the exterior to render the system inoperative. The deactivation by heating may include softening of the detent arrangement to destress the spring.

The system may be made in various forms with the basic concept described above. For example, the second signal emitter can be a high-frequency transmitter which can be connected by the released pin to a battery and thereby turn on. This system is relatively expensive and can be used practically only for the protection of expensive garments in a crowded salesroom where other alternatives are not possible.

It has been found to be most advantageous to constitute the second signal emitter as a pressurized gas vessel to which an ultrasonic whistle is affixed, the whistle being blocked by a frangible membrane which is pierced by the pin when it is released. Of course, the second signal transmitter may also be a tuning fork which is electrically energized or mechanically activated by the released pin.

According to another feature of the invention, the first signal emitter is a permanent magnet and the monitoring arrangement at the portals of the premises comprises a device responding to magnetic fields. By comparison with other passive signal transmitters of the prior art, the use of permanent magnets constitutes a vast improvement because of the sensitivity of response thereto of an appropriate monitoring device. The measurement may be made by conventional proton-resonance apparatus or by means of an induction loop. A differential measurement system with such high sensitivity apparatus can detect the proximity of the permanent magnet even before a thief reaches the exit, thereby enabling an earlier response to the acts of the thief.

The receivers are preferably spacedly disposed on the premises so that each receiver will detect the signal of the second emitter at a time which differs from the reception time of the other receivers, the time difference representing the distance of the signal source from the respective receiver. By conventional control circuitry connected to these receivers, the location of the signal source can be communicated directly and displayed by means of a digital calculator on the screen of a television monitor. Of course, optical or acoustical warning signals may, in addition or alternatively, be generated in the region of the receiver closest to the location of the signal source.

An antishoplifting system for protecting a premises against the theft of goods thus comprises a plurality of signal transmitters affixed to respective articles of the goods, each of the transmitters comprising a housing, a first continuously effective passive signal emitter in the housing, a second stored-energy triggerable signal emitter in the housing, and means on the housing for triggering the second emitter upon removal of the transmitter from the respective article. Means is responsive to the first signal emitter for signaling the removal of an article carrying the transmitter thereof from the premises, and means is also provided to respond to the signals from the second emitter for localizing the source thereof on the premises.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
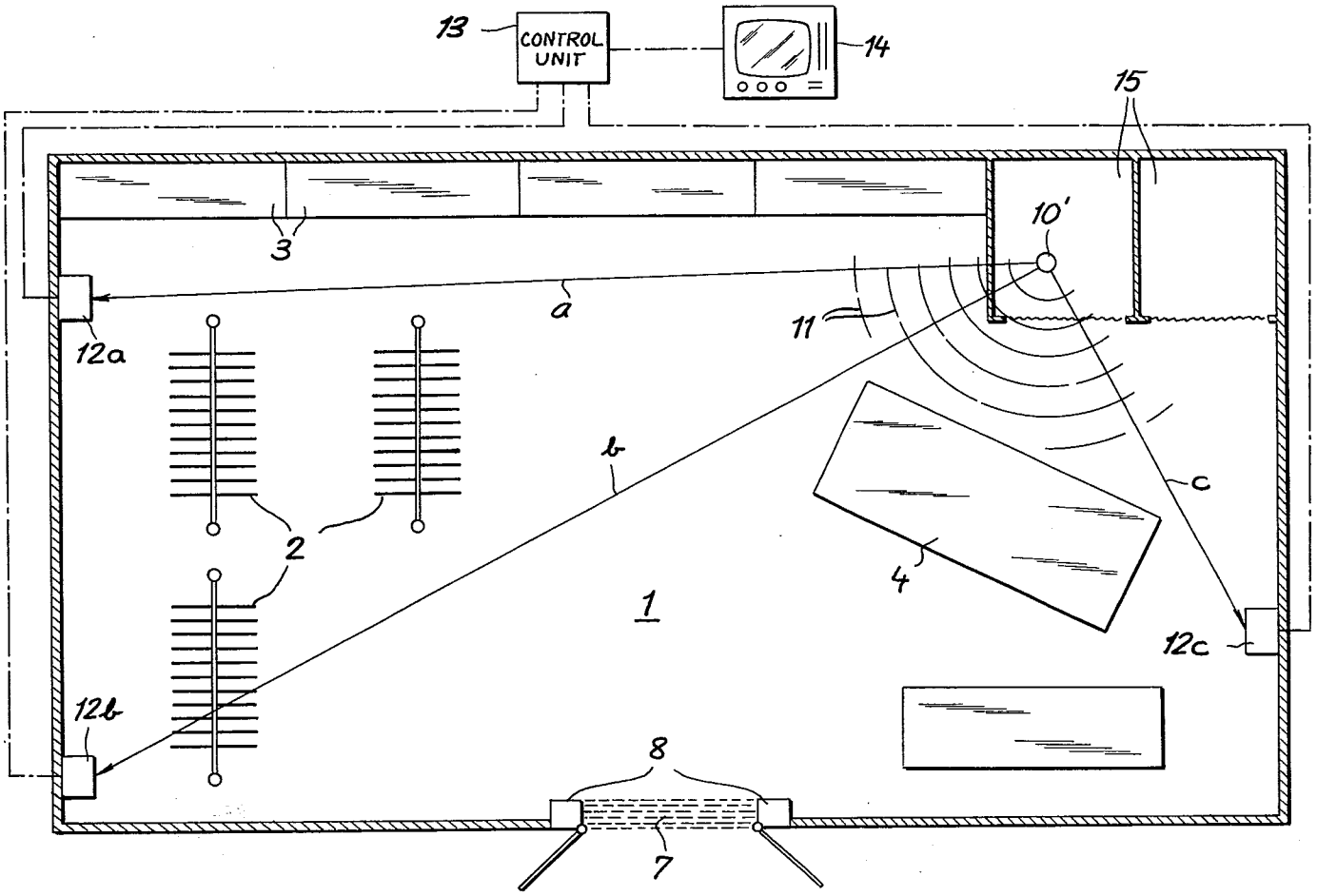
FIG. 1 is a diagrammatic plan view of a salesroom protected with the system of the present invention.

In FIG. 1 I have shown a salesroom 1 in which the goods, for example garments, are stored on hanger racks 2, on shelves, in closets or cabinets 3 or upon tables 4 for examination by potential purchasers.

On each article of the goods a signal transmitter 5 is fixed which includes a continuously effective first emitter, e.g. a permanent magnet 6, to which a first monitoring device 8 responds. The monitoring device 8 can consist of a pair of proton-resonance magnetic field detectors flanking the portals of the exit 7 from the premises. The two proton-resonance apparatuses provide a differential mesurement of an approaching magnetic field and signal an attempt by a thief to leave the premises with a garment carrying a transmitter 5.

Each of the transmitters 5 also comprises a second emitter 10, having a stored-energy source, which is normally ineffective and of a construction which will be developed below.

When the transmitter 5 is removed from a garment, its second emitter 10 is activated as shown from the unit 10' in FIG. 1. The so-generated signal 11 is detected by a monitoring system **12*a*, 12*b*, 12*c* whose receivers are spaced apart from one another and distributed about the sales premises. According to the location at which the attempt to remove the transmitter of unit 10'** was made, the pathways *a, b,* and *c* of the signals 11 to the several receivers **12*a* – 12*c* will be relatively greater or less and thus the signal will reach the receivers at different times. The transit time difference is detected by the control unit 13 which draws upon its memory to display the locus of the attempted transmitter removal upon the television monitor 14. A locating system of this type is described in the HANDBOOK OF TELEMETRY AND REMOTE CONTROL, McGraw-Hill Book Co., New York, 1967. Thus, in the embodiment illustrated, when the signal emanates from one of the dressing rooms 15, this fact is immediately displayed on the television monitor 14**.

Figure 2:
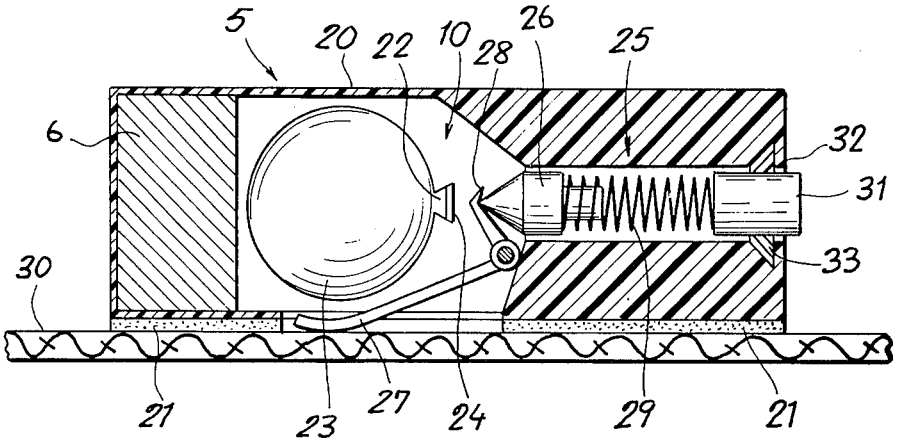
FIG. 2 is a vertical section through a transmitter according to the invention.
Figure 3:
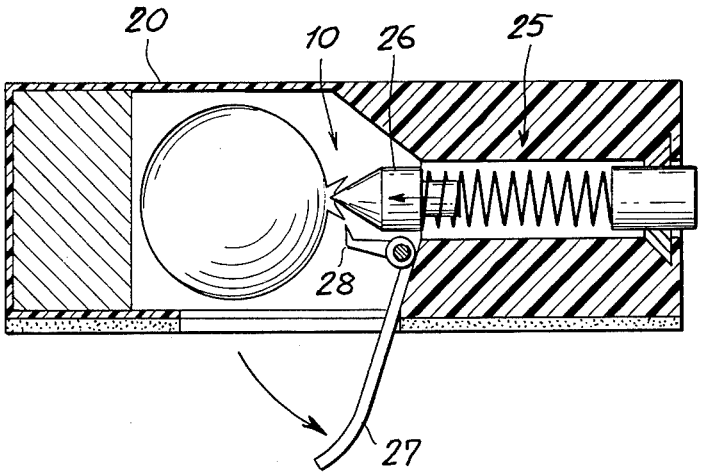
FIG. 3 is a similar view of the transmitter in its actuated state.

Each signal transmitter 5 can be constructed as generally illustrated in FIGS. 2 and 3. A housing 20 is provided with a pressure adhesive 21 whereby it can be affixed to a garment 30. Of course, pins or other types of releasable attachments can also be used.

The housing 20 encloses a permanent magnet 6, constituting the first or passive emitter, and an energy-storage second or active emitter generally illustrated at 10.

The emitter 10 is provided with an ultrasonic whistle 22 whose energy supply is a gas-storage vessel 23 which may contain gas under pressure or a chemical agent capable of producing gas upon activation. Depending upon the desired duration of the signal and its intensity, this vessel may be constituted of steel although it is preferably made integral with the ultrasonic whistle 22 out of a synthetic-resin material. A membrane 24 closes the whistle 22 and can be pierced by a pin 26 of a triggering device generally represented at 25 and mounted in the housing.

Upon piercing of the membrane 24, the gas from the vessel 23 is released and passed through the whistle 22 to generate an ultrasonic sound detectable by receivers 12*a* – 12*c*. The ultrasonic frequency is not critical but should be above that which can be detected by the human ear and a frequency, e.g. 20,000 Hz, which is not normally interfered with by the sounds in the sales area and does not correspond to an harmonic thereof. To ensure maximum output of the device, the ultrasonic frequency should correspond to one of the characteristic frequencies of the housing 20.

Figure 7:
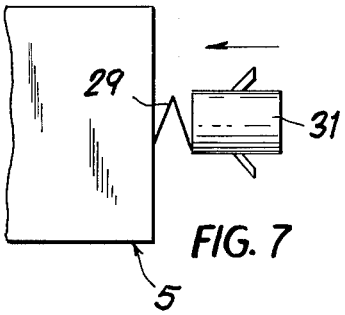
FIG. 7 is an illustration of the setting means for the transmitter before the latter is cocked.
Figure 6:
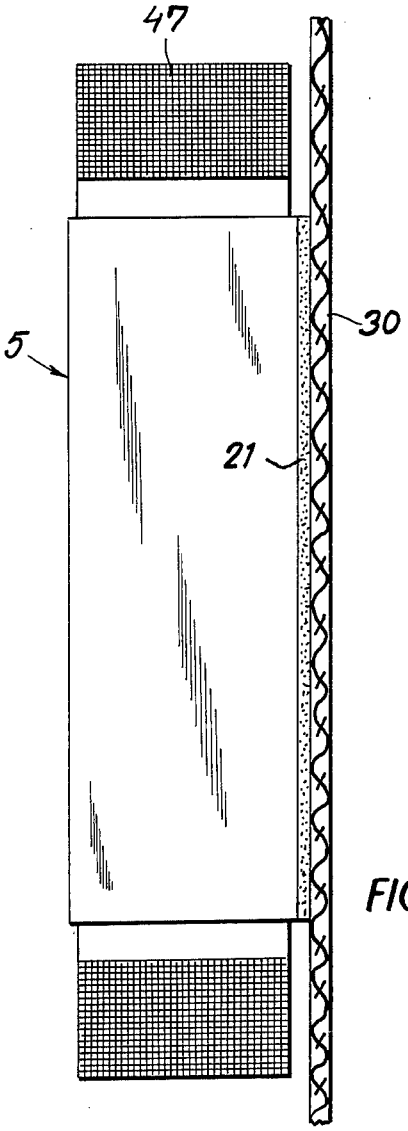
FIG. 6 is a sectional view illustrating a system for inactivating the transmitter before it is removed from the garment assuming a normal sales transaction.

The triggering device 25 comprises a lever pivotally mounted in the housing and having an arm or finger 27 which passes through a window in the housing to engage the goods 30. The other arm 28 of the lever engages the pin 26 and prevents the latter from piercing the membrane 24 unless the finger 27 is able to swing through its opening. The pin 26 is biased by a spring 29 toward the membrane 24, the spring 29 being braced against a seat 31. The seat 31 is formed as a pushbutton with elastic detent wings 33 so that it can be pressed into the housing (see FIG. 7) to compress the spring 29, whereupon the wings 33 engage abutments 32 of the housing to retain the seat 31 in place. Since member 31 cannot be withdrawn, the system in its cocked condition (FIG. 2) cannot be deactivated by a thief.

However, should the transmitter be removed from the garment, the pin 26 will spring forward to pierce the membrane 24 (see FIG. 3).

Figure 4:
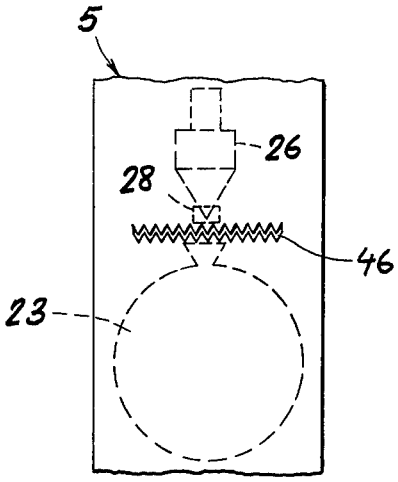
FIG. 4 is a plan view of a portion of the transmitter illustrating a means for inactivating same.
Figure 5:
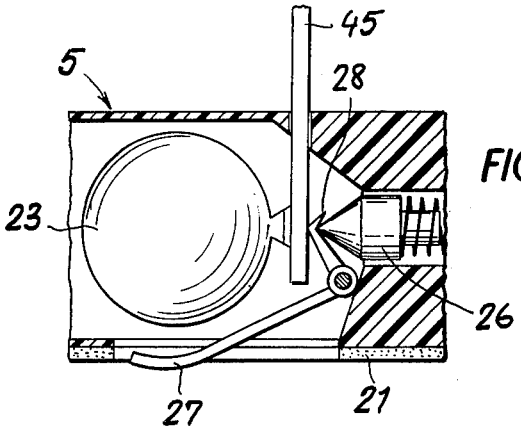
FIG. 5 is a sectional view illustrating the inactivating key which can be used in the FIG. 4 embodiment.

To deactivate the device, a special blade 45 may be inserted through a special hole 46 to prevent piercing of the membrane (see FIGS. 4 and 5), whereupon the system can be reused after removal from the garment.

If reuse is not necessary or desirable, the unit can be inserted within a coil 47 to inductively heat the spring and thereby break the latter by inductive heating.

I claim:

1. An antishoplifting system for protecting a premises against theft of goods therefrom, comprising:

a plurality of signal transmitters affixed to respective articles of said goods, each of said transmitters comprising:

a housing, a first, continuously effective, signal emitter in said housing, a second, stored-energy, triggerable signal emitter in said housing, and means on said housing for triggering said second emitter upon the removal of the transmitter from the respective article;

means responsive to said first signal emitter for signaling the removal of an article carrying the transmitter thereof from the premises; and means responsive to a signal from said second emitter upon the triggering thereof for localizing the source of said signal on said premises.

2. The system defined in claim 1 wherein said triggering means includes means operable from the exterior of said housing for cocking said triggering means and preventing the deactivation thereof from the exterior.

3. The system defined in claim 2 wherein said triggering means includes a lever pivotally mounted in said housing and having an arm resting against the respective article and another arm, a pin bearing against said other arm, a spring urging said pin against said other arm, said second signal emitter being disposed in the path of said pin for activation thereby upon disengagement of the first-mentioned arm of said lever from the respective article.

4. The system defined in claim 3, further comprising a seat for said spring formed with an unidirectionally effective detent engageable with said housing upon insertion of said seat into same to compress said spring.

5. The system defined in claim 1, further comprising a tool for deactivating said triggering means to prevent activation of said second signal emitter.

6. The system defined in claim 1 wherein said second signal emitter is a pressurized-gass storage vessel formed with an ultrasonic whistle closed by a membrane pierceable by said triggering means.

7. The system defined in claim 1 wherein said first signal emitter is a permanent magnet and said means responsive to said first signal emitter is a device for detecting a magnetic field.

8. The system defined in claim 1 wherein said means responsive to a signal from said second emitter comprises a plurality of spaced-apart receivers and circuit means connected to said receivers and responsive to the differences in transit time of said signal thereto for generating an output representing the location of the source of said signal.

9. The system defined in claim 8 wherein said signal is an ultrasonic signal.

* * * * *